US006250040B1

(12) United States Patent
Green

(10) Patent No.: US 6,250,040 B1
(45) Date of Patent: Jun. 26, 2001

(54) SOLID CORE VINYL SCREEN DOOR

(76) Inventor: Guerry E Green, One Better Way, Georgetown, SC (US) 29440

( * ) Notice: Subject to any disclaimer, the term of this patent is extended or adjusted under 35 U.S.C. 154(b) by 0 days.

(21) Appl. No.: 09/459,162

(22) Filed: Dec. 10, 1999

(51) Int. Cl.[7] ..... E04C 2/38
(52) U.S. Cl. ..... 52/656.7; 52/455; 52/656.9
(58) Field of Search ..... 52/656.2, 656.1, 52/656.4, 656.7, 656.9, 204.1, 202, 203, 455, 63

(56) References Cited

U.S. PATENT DOCUMENTS

| | | | | |
|---|---|---|---|---|
| 3,932,245 | | 1/1976 | Erb et al. . | |
| 4,084,360 | * | 4/1978 | Reckson | 52/63 |
| 4,179,540 | | 12/1979 | Smarook . | |
| 5,152,116 | * | 10/1992 | MacGowan | 52/473 |
| 5,363,611 | * | 11/1994 | Richardson | 52/309.4 |
| 5,620,642 | | 4/1997 | Kamite et al. . | |
| 5,653,074 | * | 8/1997 | Yoon | 52/210 |
| 5,706,607 | * | 1/1998 | Frey | 49/478.1 |
| 5,737,890 | * | 4/1998 | Heyden | 52/455 |
| 5,761,860 | * | 6/1998 | Koike | 52/204.67 |
| 5,797,223 | * | 8/1998 | Shoup | 52/204.1 |
| 5,848,505 | * | 12/1998 | Taylor | 52/202 |
| 6,035,583 | | 3/2000 | Papke . | |
| 6,054,207 | | 4/2000 | Finley . | |

* cited by examiner

*Primary Examiner*—Beth A. Stephan
(74) *Attorney, Agent, or Firm*—Michael A Mann; Nexsen Pruet Jacobs & Pollard LLP

(57) ABSTRACT

A screen door made of foamed, closed-cell, solid-core polyvinyl chloride includes two rails and two stiles connected together to form a rectangular frame having an opening. A groove is milled into the frame around the opening. The screen that is to cover the opening is fastened to the frame by pressing it with a spline into the groove. The rails and stiles are connected using dowels in addition to adhesives, or, alternatively, using screws and traditional mortise and tenon joints. Holes are drilled into the stiles and then screws are driven into the rails from within the holes. The holes are then filled with foamed plastic plugs over the screws. The screen door can be cut and trimmed at the job site to fit it to the particular door frame, removing up to about an inch from each edge.

23 Claims, 6 Drawing Sheets

SOLID CORE VINYL SCREEN DOOR

FIELD OF THE INVENTION

The present invention relates generally to screen doors and to their manufacture and installation. The present invention also relates generally to the use of plastics, and in particular, vinyl, as replacements for wood-based products.

BACKGROUND OF THE INVENTION

Traditionally, screen doors have been made of wood or metal, such as aluminum. Wood has drawbacks, however. It must be painted or coated to protect it from the elements. If made of less expensive woods, such as pine, it may split or warp easily. It may be attacked by mold and fungus. Aluminum doors are much more expensive.

Polyvinyl chloride has been used in place of wood in siding for years. Recently, other uses of this material have been made. For example, interior shutters and parts of windows are now commonly made of vinyl. Windows and shutters, whether vinyl or wood, are made to order are made to measurements rather than custom-fitted at the job site. The dimensions of the window frame are supplied to a manufacturer who builds the shutters or windows to the measurements. These items are hollow, with walls typically less than ⅛th inch thick, to save material and decrease weight. For added strength, ribs or other interior structures are added as needed. In some cases, metal bars are used to reinforce operable, exterior shutters.

As a practical matter, screen doors cannot be made of the same materials as vinyl shutters and windows. The door needs to fit closely in a door frame that may not be rectangular or "plumb" but may lean or be narrower at the top or bottom. A screen door made of wood can be cut and trimmed on the job site. A hollow core vinyl door, on the other hand, especially one with metal reinforcing bars, could not be trimmed on the job site without the risk of cutting through the wall, generally less than ⅛ inch thick, without jeopardizing with the structural integrity and appearance of the door. Finally, shutters and windows are usually ordered in quantity, unlike screen doors. Therefore, there is little incentive to provide screen doors made to measurement.

Foamed plastics, and vinyls in particular, are sometimes used for interior ceiling and floor molding, brick molding or picture frame molding. The ends of these materials are cut to length at the job site and nailed into place. However, molding does not support weight, does not take the abuse of a screen door nor is it as complex a structure as a screed door. For example, a screen door must support the screen and hardware on a multi-component frame.

Thus, there remains a need for a screen door that does not have the disadvantages of either aluminum or wood, that can be custom fitted at the job site, unlike hollow core shutters and windows, and will take abuse.

SUMMARY OF THE INVENTION

According to its major aspects and briefly recited, the present invention is a screen door wherein the frame is made of foamed, closed cell polyvinyl chloride instead of wood or other material. In particular the stiles and rails of which the frame is comprised are formed on a substantially solid, extruded vinyl rather than a hollow core vinyl and are fastened together with screws or dowels and adhesive to form a rectangular frame with an opening defined between the stiles and rails for the screen. A groove is then milled into the frame around the screen opening for receiving the screen and the spline that holds it in place.

The door frame can be taken, along with the usual door hardware, to the job site. There, the edges of the door frame are cut and trimmed using standard woodworking tools to fit the door to a particular door frame. The screen is fastened to the door frame using the spline to hold the screen into the groove.

An important feature of the present invention is the preferred choice of material, namely, foamed, close-cell polyvinyl chloride, and most preferably, vinyl extruded with a Celuka finish. This material has the weight and the look and feel of painted wood but needs far less maintenance. It does not require painting but can be painted. It can be molded with a wood grain and with anti-fungal chemicals. The Celuca finish is smooth, hard and resistant to both scratches and dents.

The use of solid foamed polyvinyl chloride is another important feature of this invention. The use of solid polyvinyl chloride permits the edges of the door frame to be trimmed, removing even more than an inch from each edge is possible to fit the door to a particular door frame. Not only is trimming possible, but other operations using standard wood working tools, such as drilling, routing, milling, and planing, making installation of hardware as convenient with the present material as will wood. Furthermore, solid material does not split, as wood does, allowing the stiles and rails to be fastened by screws that can bite into the material and the material closes around them for a superior joint.

Another important feature of the present invention is the use of a milled groove around the screen opening to hold the screen and spline. This groove is cut, preferably with longitudinal ridges complementing the teeth on the spline wherein the purpose of the ridges is to secure the spline better. The groove is dimensioned to receive the screen and the resilient spline so the screen can be securely fastened to the frame. The spline and screen are pressed into the groove using a simple tool.

Being able to trim and cut the door frame at the work site is another important feature of the present invention. This feature makes it possible to custom fit a standard, oversize door to most door frames for a perfect fit without the need to measure the door frame and then build the screen door to measurements.

Other features and their advantages will be apparent to those skilled in the art of manufacturing and installing screen doors from a careful reading of the preferred embodiments accompanied by the following drawings.

DETAILED DESCRIPTION OF PREFERRED EMBODIMENTS

The present invention is a screen door made of foamed plastic, preferably foamed, closed-cell polyvinyl chloride (PCV), having certain structural features to give it useful properties; namely, strength, durability, and an attractive appearance.

Foamed, closed-cell PVC is well known. Vinyl chloride beads and a foaming agents, plus other ingredients such as anti-fungal agents and coloring agents, are fed into a plastic extrusion machine where the beads are heated until they soften and combine into a flowing liquid. The liquid is forced through a die as it foams from the outside in. The extruded product is cut into lengths for manufacturing into the various elements of the screen door, as will now be described. A well-known variation of this process, the Celuka process, results in a harder finish where the density of the vinyl varies from greatest on the surface to least in the center. A Celuka finish needs no paint but can take a latex paint, if desired.

Figure 1:
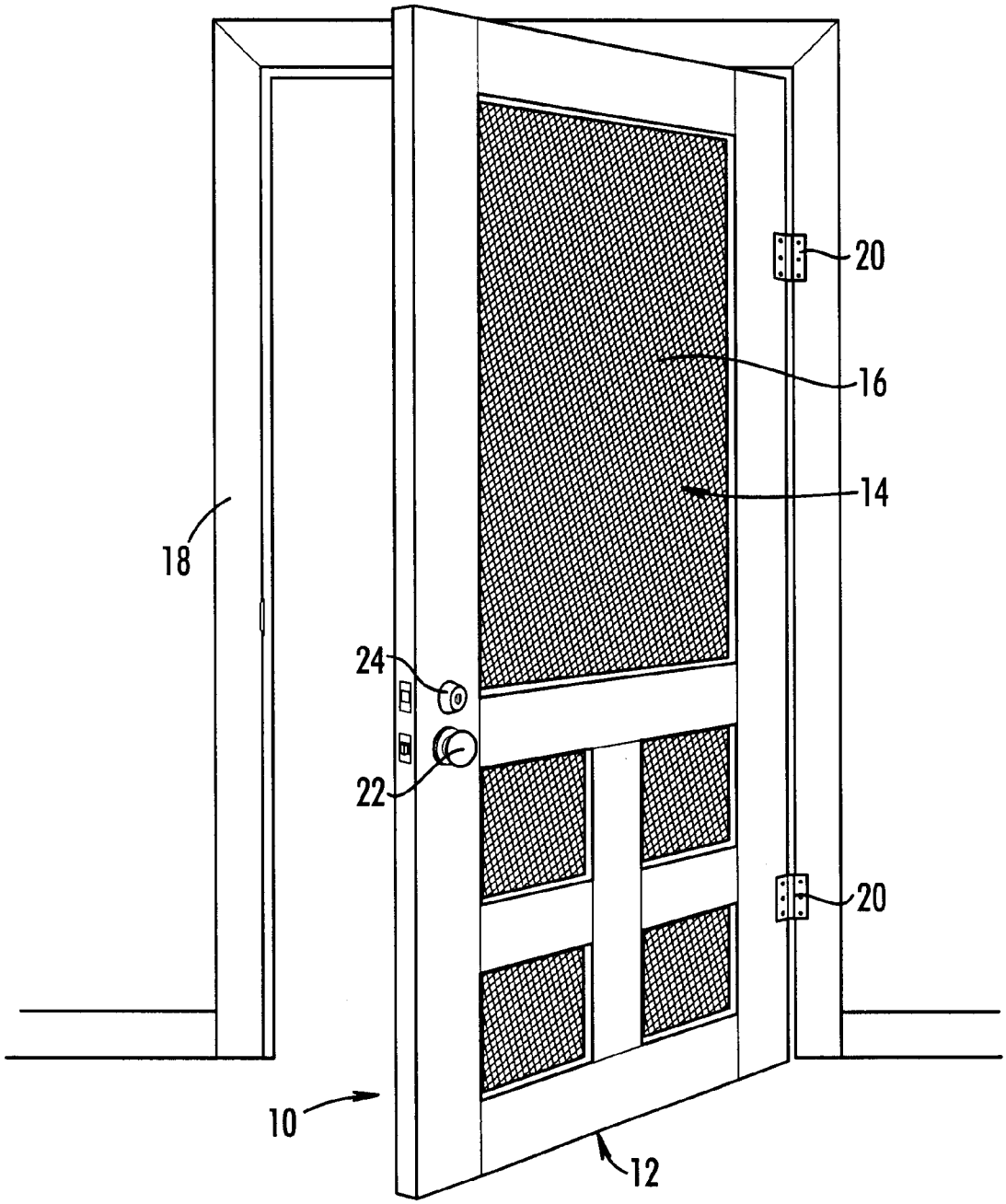
FIG. 1 is a perspective view of a screen door, according to a preferred embodiment of the present invention.
Figure 2:
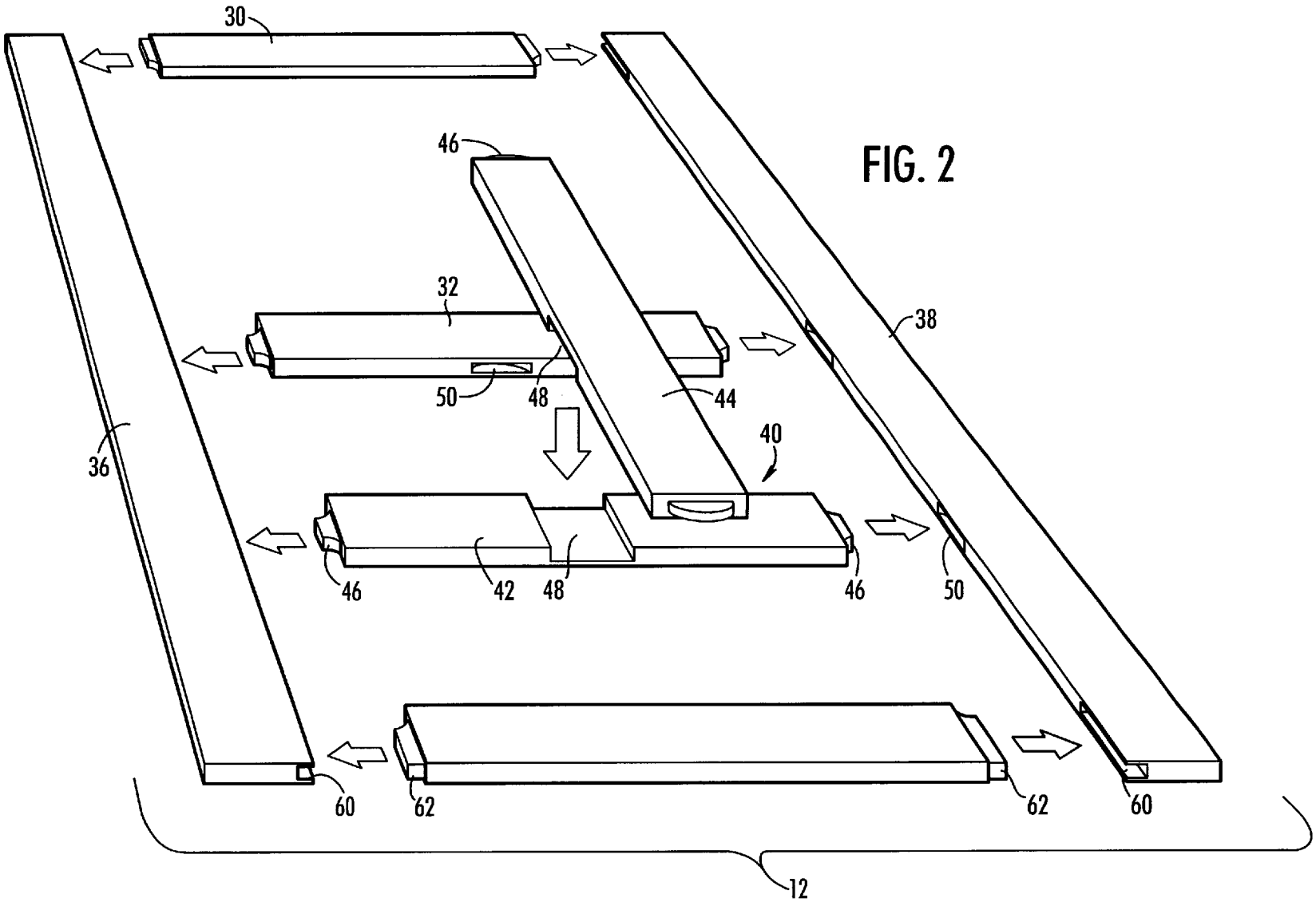
FIG. 2 is an exploded view of a frame for a screen door, according to a preferred embodiment of the present invention.

The screen door, indicated by reference numeral 10, includes a rectangular frame 12 and a screen 14 made of standard screening material, namely, woven metal or plastic wires adapted to admit air but exclude insects. Frame 12 defines an opening 16 for screen 14, which is dimensioned to cover opening 16. In FIG. 1, screen door 10 is shown attached to a door frame 18 using hinges 20. A door handle 22 and a lock 24 are also illustrated, however, other hardware customarily used with prior art screen doors (springs, door closing pistons, etc.) may also be used with screen door 10 as easily as with a wood screen door.

Frame 12 is made of rails and stiles. There are three rails, 30, 32, and 34, and two stiles 36 and 38. An optional cross piece 40 fits between rails 32 and 34 and stiles 36 and 38 and is made of members 42 and 44. Stiles 36 and 38 are spaced apart; rails 30 and 34 are spaced apart. Then stiles 36 and 38 are joined to rails 30 and 34 to form frame 12. Rail 32 adds stiffening to frame 12; cross piece 40 provides additional strength and improves appearance. Overall, however, frame 12 has an appearance similar to that of prior art screen doors.

Members 42 and 44 have projections 46 on each end which may be made in different shapes to facilitate assembly, and have notches 48 so that members 42 and 44 mate with each other. Projections 46 correspond to recesses 50 in rails 32 and 34 and in stiles 36 and 38 so that projections 46 of members 42 and 44, mated together at notches 48, can be seated in recesses 50. An adhesive suitable for joining PCV to itself is used to secure these components together.

Figure 3A:
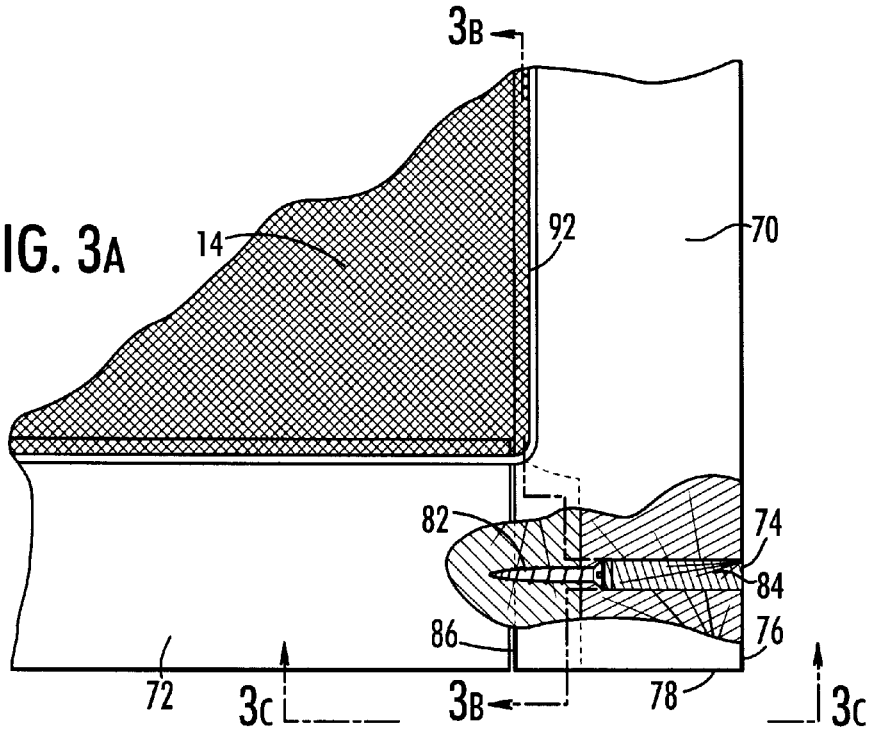
FIGS. 3A, 3B, which is taken along line 3B—3B of FIG. 3A, FIG. 3C, which is taken along lines 3C—3C of FIG. 3A, and FIG. 3D, showing an alternative embodiment, are detailed views of a corner of a screen door showing the connection between stile and rail and the fastening of the screen to the frame, according to a preferred embodiment of the present invention.
Figure 3B:
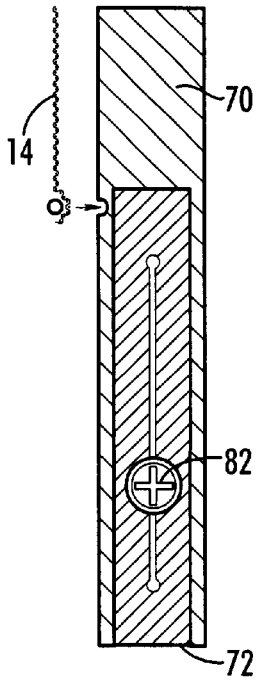
Figure 3C:
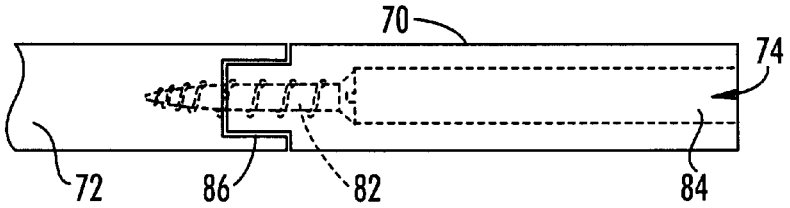
Figure 3D:
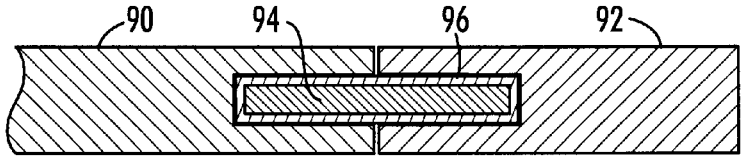
Figure 4:
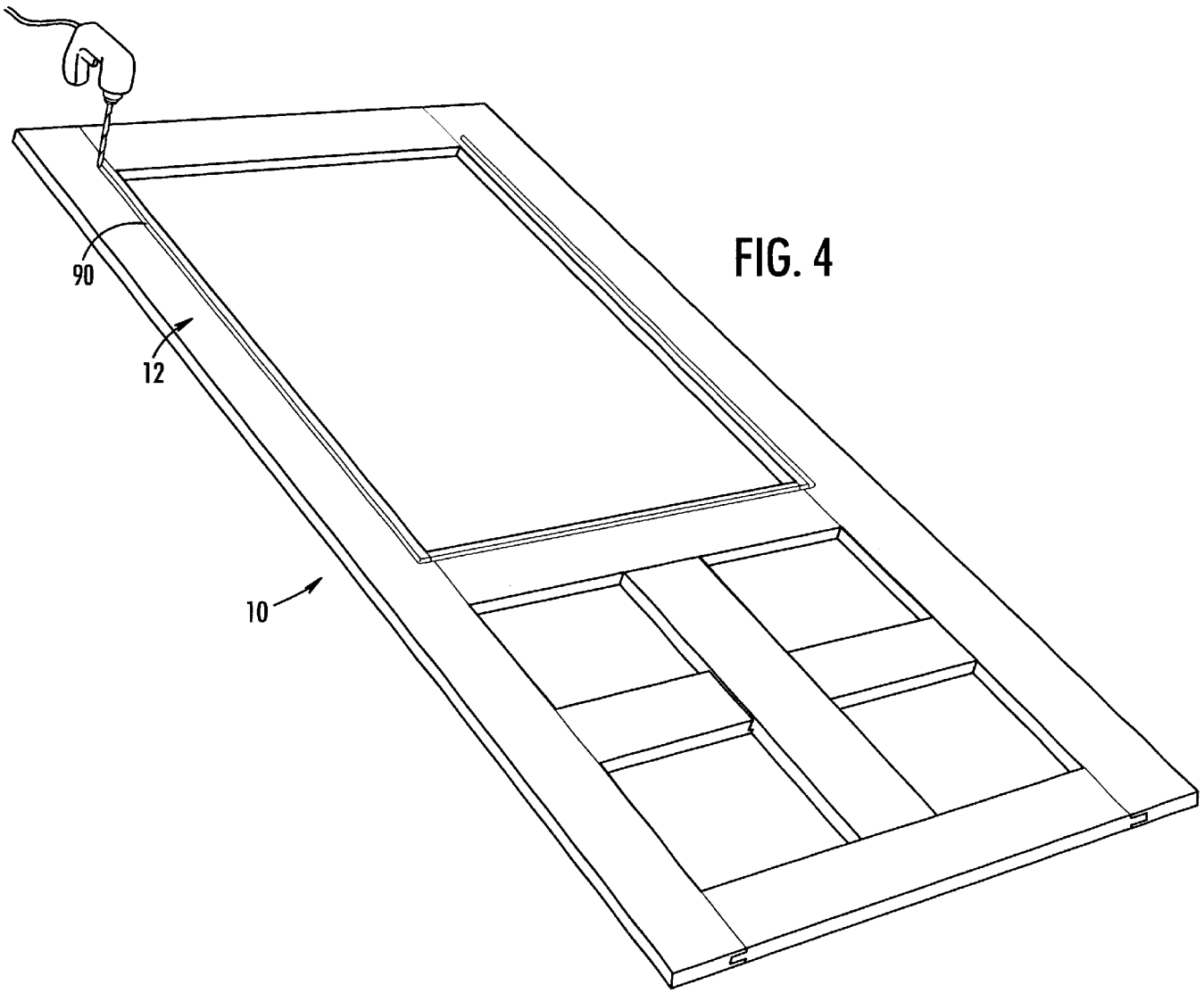
FIG. 4 is a perspective view of a screen door frame showing the groove being milled in the frame, according to a preferred embodiment of the present invention.
Figure 5:
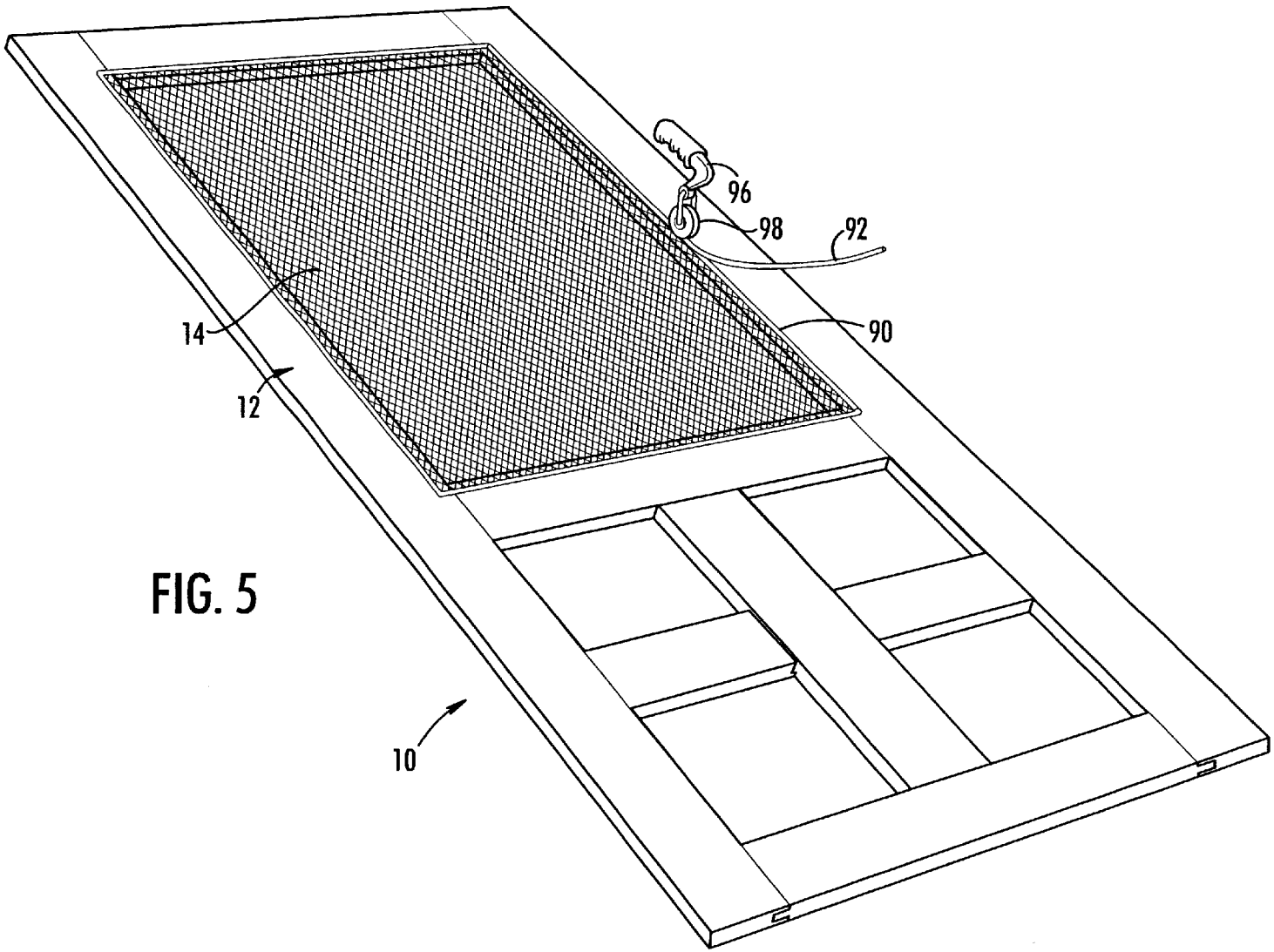
FIG. 5 is a perspective view of a screen door with the screen being installed in the opening by pressing a spline into the groove.

Stiles 36 and 38 are formed with a mortise recesses 60 at each end and in the middle and rails 30, 32 and 34 are formed with corresponding tenon projections 62 so that stiles 36 and 38 can be attached to rails 30, 32, and 34. These particular features, mortise recesses 60 and tenon projections 62, as well as notches 48, projections 46 and recesses 50 are formed using standard wood working machinery. These components can be worked with standard machinery because they are solid, meaning that there are no hollow cores or regions formed inside them. Rails 30, 32, and 34, and stiles 36 and 38, and members 42 and 44 are formed to have a substantially solid cores. The centers of these may be less dense than the outsides—and at most there may be a slender "dog bone"-shaped hole 114 (FIG. 3B) left as a result of the inwardly-forming plastic cells and small variations in the amount of material and foaming agent in the initial composition—but otherwise, they are solid. Preferably the Celuka process is used to form these components so that, when extruded and cooled, they have a hard, durable finish that is scratch and dent resistant. They can be painted (or extruded in colors) using a latex paint, and anti-fungal compounds can be incorporated in them so mold and mildew do not readily form on them in use.

To increase the security of the attachment of stiles 36 and 38 to rails 30 and 34, screws or dowels are strongly preferred. FIGS. 3A–3D illustrate the way a stile 70 is fastened to a rail 72. A hole 74 is drilled into an edge 76 of stile 70 near an end 78, but preferably a few inches from end 78, and a screw 82 is inserted far enough to bite into rail 72. Screw 82 is preferably a 3 to 3½ inches long. Hole 74 is then filled with a foamed PVC plug 84. Wood, in the thickness of rail 72, preferably less than one inch, would often split when a 3 to 3½ inch screw is driven into it. Closed cell PVC, however, receives screw 82 and, in fact, tends to grip it better than wood and much better than a hollow core foamed PVC door.

An adhesive 86 is preferably but optionally used in addition to screw 82 to connect stile 70 to rail 72. Thus, stile 70 and rail 72 are joined by a mortise and tenon joint, an adhesive and a screw to butt the rail snugly against the stile and hold the joint in place while the adhesive cures but without waiting for the adhesive to cure before screen door 10 can be handled.

Alternatively to the mode of fastening stiles 70 to rails 72 using screws 82 and mortise and tenon joints, one may prefer dowels pressed into holes drilled into stiles 90 and rails 92, preferably at least two dowels per joint, thus eliminating the need for the mortise and tenon joint.

Holes would be carefully measured for proper alignment and then drilled to receive a dowel 94. A small amount of adhesive 96 would then be injected into the holes in either a stile 90 or rail 92, just before one end of dowel 94 is inserted and tapped into position. Then adhesive 96 would be injected into the hole in the other member, and the opposing end of dowel 94 inserted into it. The two members, stile 90 and rail 92, are pressed together until dowel 94 is fully seated.

The next step in manufacturing screen door 10 is to mill a groove 110 in frame 12 around opening 16. Groove 110 is dimensioned to hold screen 14 and a spline 92 so that screen 14 can be fastened to frame 12. As noted above, foamed closed-cell PVC is milled with the same machinery as wood. Groove 110 is preferably slightly rounded at corners 94 and is either "U" shaped in profile or slightly narrower at its opening. To install screen 14, it is placed over goove 110 and then spline 112 placed over screen centered on groove 110. A simple tool 106 having a wheel 98 with a concave edge is used to press spline 112 into groove along with screen 14. The act of pressing spline 112 and screen 14 into groove 110 tightens screen 14.

Figure 6:
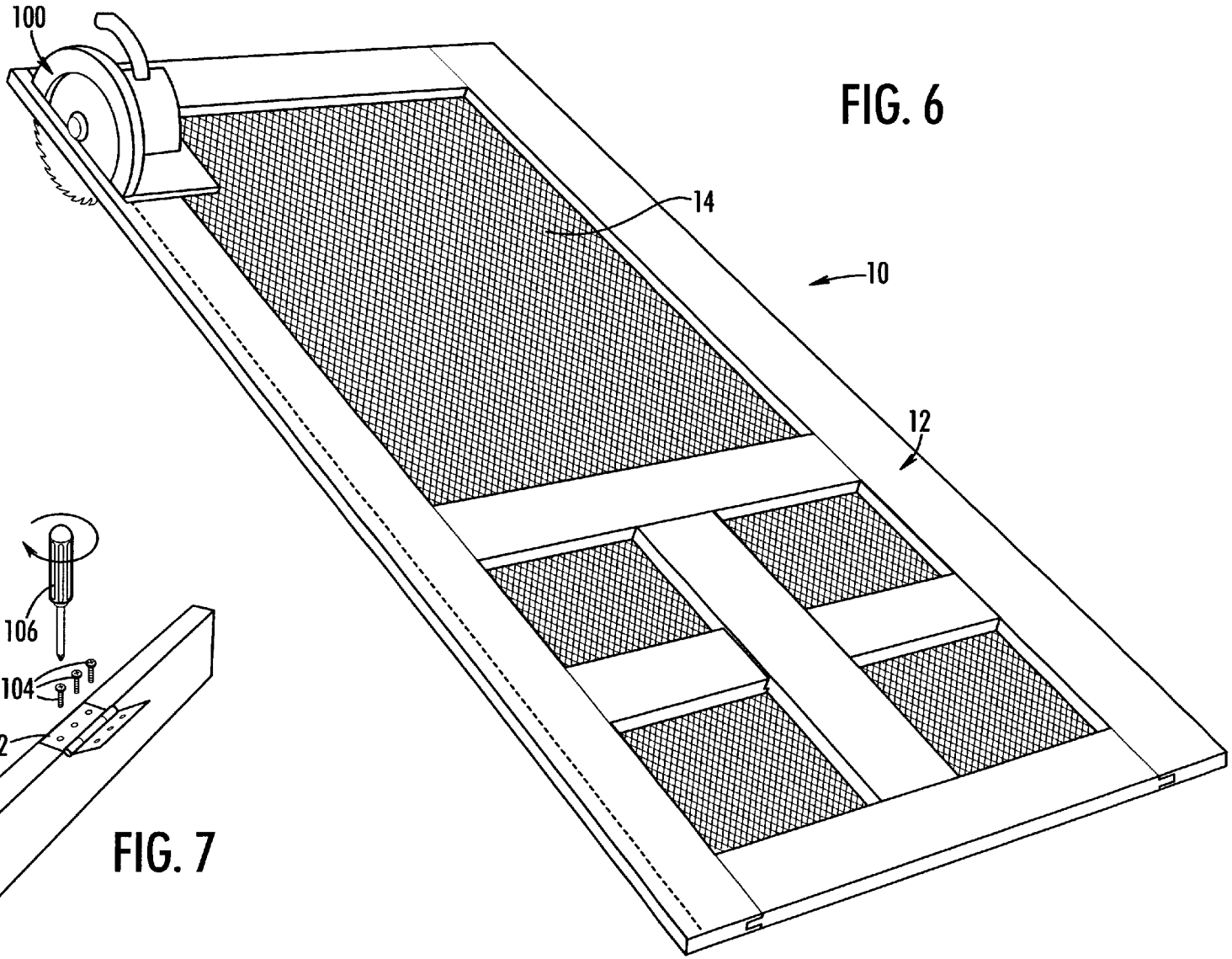
FIG. 6 is a perspective view of a screen door being cut and trimmed using a circular saw, according to a preferred embodiment of the present invention.
Figure 7:
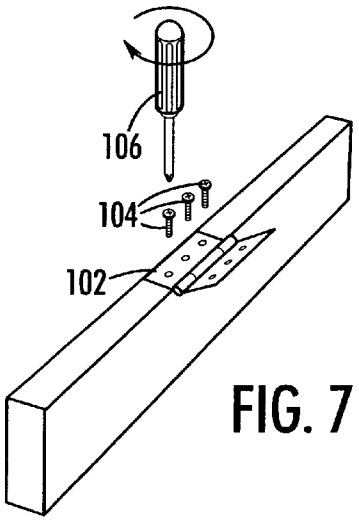
FIG. 7 is a detailed view of an edge of a screen door with a hinge being installed, according to a preferred embodiment of the present invention.

At the job site, screen door 10 can be cut an trimmed, even sanded, to achieve a custom fit on site. Cutting can be done with any wood saw, such as the circular saw 100 shown in FIG. 6. Almost any amount of material can be removed from the edges of screen door 10, from less than ¼ inch to more than an inch. Preferably, screen door 10 is made with about ½ inch margin over standard door width and not more than approximately one inch is removed from any edge. This capability to fit a solid screen door simply does not exist in a hollow core plastic door. As shown in FIG. 7, hardware items such as hinges 102 can be attached by screws 104 with a screw driver 106, as shown, or a power screw driver. Because the material of which frame 12 is made is simply closed cell PVC, hardware may be placed where desired.

The present invention is not limited to screen doors. Other doors and windows can be made of the same material where cutting and trimming at the job site is a desirable characteristic. For example, in restoring old homes, the ability to custom fit a window or door at the job site is very important.

It will be apparent that many changes and substitutions can be made to the foregoing preferred embodiments without departing from the spirit and scope of the invention, defined by the appended claims.

What is claimed is:

1. A screen door, comprising:

two spaced apart stiles;

two spaced apart rails, said two rails and two stiles being connected together to form a rectangle having an opening defined by the distances said rail and said stiles are spaced apart;

a screen dimensioned to cover said opening; and means for fastening said screen to said two rails and said two stiles, said two rails and two stiles being made of solid foamed plastic.

2. The screen door as recited in claim 1, wherein said foamed plastic is closed cell foamed plastic.

3. The screen door as recited in claim 1, wherein said foamed plastic is foamed vinyl.

4. The screen door as recited in claim 1, wherein said foamed plastic is polyvinyl chloride.

5. The screen door as recited in claim 1, wherein said two rails and two stiles have edges and said edges are adapted to be trimmed and cut by at least one-eighth of an inch so that said screen door fits a doorway.

6. The screen door as recited in claim 1, wherein said two rails and two stiles have edges and said edges are adapted to be trimmed and cut by up to approximately one inch so that said screen door fits a doorway.

7. The screen door as recited in claim 1, wherein two rails and said two stiles are connected together using only screws and mortise and tenon joints.

8. The screen door as recited in claim 1, wherein said two rails and two stiles are connected together using only dowels and adhesives.

9. The screen door as recited in claim 1, wherein said two rails and two stiles are connected together using screws countersunk into said stiles by at least one inch, forming holes.

10. The screen door as recited in claim 9, further comprising foamed plastic plugs inserted in said holes.

11. The screen door as recited in claim 1, wherein said rectangle has a groove formed therein, said groove running continuously from rail to stile around said opening.

12. The screen door as recited in claim 1, wherein said fastening means is a spline, and said rectangle has a groove formed therein running around said opening and dimensioned dimensioned to receive said spline.

13. A screen door, comprising:

two rails and two stiles connected together to form a rectangular frame that defines an opening, said rectangular frame having an outer edge;

a screen dimensioned to cover said opening; and means for fastening said screen to said rectangle, said two rails and two splines made of foamed plastic and adapted to be trimmed and cut along said outer edge by up to approximately an inch.

14. The screen door as recited in claim 13, wherein said rectangular frame has a groove milled therein around said opening, and wherein said fastening means is a spline dimensioned to fit into said groove.

15. The screen door as recited in claim 13, wherein said rails and said stiles are connected together with dowels.

16. The screen door as recited in claim 15, wherein holes are formed in said stiles and said rails, and said dowels are inserted into said rails and said stiles along with an adhesive.

17. A screen door made by a process comprising the steps of:

forming a rectangular frame of solid plastic rails and stiles, said rectangular frame having an opening;

drilling holes into said stiles;

connecting said rails and stiles by screws driven into said rails from said holes in said stiles;

forming a groove in said rectangular frame around said opening;

pressing a screen into said goove with a spline; and cutting said rectangular frame to fit a door frame.

18. The screen door as recited in claim 17, wherein said rails and stiles are made of polyvinyl chloride.

19. The screen door as recited in claim 17, wherein said rails and stiles are made of foamed, closed-cell plastic.

20. The screen door as recited in claim 19, wherein said plastic is polyvinyl chloride.

21. A screen door made by a process comprising the steps of:

forming a rectangular frame of closed-cell, substantially solid plastic rails and stiles, said rectangular frame having an opening;

drilling holes into said stiles and rails;

connecting said rails and stiles by dowels driven into said rails and said stiles;

fastening a screen to said rectangular frame; and cutting said rectangular frame to fit a door frame.

22. The screen door as recited in claim 21, wherein said plastic is polyvinyl chloride.

23. The screen door as recited in claim 21, further comprising the steps of:

forming a groove in said rectangular frame around said opening; and pressing a screen into said groove with spline.

* * * * *

UNITED STATES PATENT AND TRADEMARK OFFICE

CERTIFICATE OF CORRECTION

PATENT NO. : 6,250,040 B1
DATED : June 26, 2001
INVENTOR(S) : Green, Guerry E.

It is certified that error appears in the above-identified patent and that said Letters Patent is hereby corrected as shown below:

Column 2,
Line 13, "Celuca" is changed to -- Celuka --

Column 3,
Line 12, "PCV" is changed to -- PVC --
Line 56, "PCV" is changed to -- PVC --

Column 4,
Line 56, "goove" is changed to -- groove --
Line 62, "an" is changed to -- and --

Column 6, claim 13,
Line 10, "splines" is changed to -- stiles --

Column 6, claim 17,
Line 33, "goove" is changed to -- groove --

Signed and Sealed this

Fifteenth Day of January, 2002

*Attest:*

*Attesting Officer*

JAMES E. ROGAN
*Director of the United States Patent and Trademark Office*